United States Patent [19]

Everett

[11] 4,157,632

[45] Jun. 12, 1979

[54] AERIAL TOY

[76] Inventor: Robert A. Everett, 704 S. East Ave., Tulsa, Okla. 74108

[21] Appl. No.: 805,517

[22] Filed: Jun. 10, 1977

[51] Int. Cl.[2] ..... A63H 27/00

[52] U.S. Cl. ..... 46/74 D; 273/106 B; 46/7

[58] Field of Search ..... 46/74 D, 75, 6, 7, 8; 273/106 R

[56] References Cited

U.S. PATENT DOCUMENTS

| | | | |
|---|---|---|---|
| D. 219,158 | 11/1970 | Gray | 273/106 B X |
| 3,359,678 | 12/1967 | Headrick | 46/74 D |
| 3,613,295 | 10/1971 | Everett | 46/74 D |

FOREIGN PATENT DOCUMENTS

| | | | |
|---|---|---|---|
| 1196552 | 1965 | Fed. Rep. of Germany | 273/106 B |

*Primary Examiner*—Russell R. Kinsey
*Assistant Examiner*—Mickey Yu
*Attorney, Agent, or Firm*—Robert A. Everett

[57] ABSTRACT

An aerodynamic toy having a series of small extended airfoils contiguous to one another, forming a large unitary aerodynamic body, whose lift surfaces has disposed a number of small depressions. Most of the body's weight is distributed in the small extended airfoils, with placement of blind holes for the addition of extra weight. The lower surface is substantially flat at the periphery and then becomes concaved shaped. The concaved surface contains a hollow tube that holds fluid and has a dispenser at the lower end for dispersing of the fluid.

9 Claims, 6 Drawing Figures

AERIAL TOY

BACKGROUND OF THE INVENTION (1) Field of the Invention

This invention relates to a saucer shaped aerodynamic toy for the purpose of being propelled through the air. More specifically the invention relates to bodies which as sustained in flight by their aerodynamic and gyroscopic forces. These forces are brought into play when the device is launched into the air with rotattional spin and force, along a flight path.

(2) Description of Prior Art

In the past, aerial toys resembling flying saucers have become popular as throwing implements. The usual construction of this type of toy is of plastic material having a thick rim at its periphery and a flat top with an open bottom section. This type configuration gives the toy's outer periphery or leading edge a smooth continuous surface that resembles that of a single airfoil, or more precisely a circular or disc type airfoil. Launching of such a device is accomplished with a backhand throwing motion with fingers gripping the open bottom edge and released into a spinning flight with a wrist snapping motion. The momentum and spin is imparted to the toy to cause it to fly or glide toward another participant in a game or toward some inanimate object. The flight path from the thrower depends upon the thrower's skill in the proper release point; the angle of the toy to the ground and also the angle of wind currents at the time of release. Other prior art which are of note, is my U.S. Pat. No. 3,613,295 which embodies many radiating airfoils with weighted tips. It has the inherent ability to fly with force and does a full roll-over in flight, and then flys on in a normal flight pattern for substantially long distances and is relatively easy to master. My patent 3,852,910 is an improvement on my above mentioned patent with the addition of control features such as flaps, a lift spoiler, pockets for additional weight and a safety ring at its periphery.

SUMMARY OF THE INVENTION

An object of the present invention is to provide a new and improved saucer type aerial toy with combined aerodynamic and gyroscopic forces built into a one piece construction. The overall aerodynamic configuration is that of an airfoil and embodies many smaller extended airfoils.

Another object of the invention is that these smaller extended airfoils contain most of the entire weight of the body and this unequal distribution of weight to near the periphery and creates a surging type centrifugal force when spinning and propelled forward in flight. This gyro type force also acts as a controlling device, since this aerodynamic aerial toy has an inherent tendency of rolling while in flight, since most of the lift forces are created on one side of the body as it spins. So there is actually two forces acting opposite each other, but all flights produce a partial roll and then fly on in a normal manner with the gyro forces keeping the toy from rolling over a second or third time while in flight. Should additional weights be desired when using the toy in high winds, which may cause over abundance of lift force and more than one roll-over in flight, then small shot or B-Bs can be placed into the blind holes located in the substantial flat bottom surface along the outer edge of each small extended airfoil. These additional weights give the aerodynamic body more anti-roll force in order to combat this extra lift factor do to the high winds that may occur.

A further object is that portions of the upper surface of the body is disposed with shallow depressions or closely spaced raised ribs, either of which, or a combination of both can serve as lift poilers. These lift spoilers result in the increasing of turbulent air flow over these areas of the airfoil and helps destroy some of the over abundance of lift and in turn, further restricts the toy's roll-over tendencies. The aerial toy with its small extended airfoils are convenient hand holds for launching the toy into flight by grasping it between two of the small extended airfoils with the throwing hand in the "V" formed by the thumb and index finger and throwing it like a baseball in an overhand fashion, imparting large amounts of force and spin by throwing and snapping of the wrist as the toy is launched and in turn creates the lift force, so each of these different types of lift spoilers and anti-roll forces all combine together in the partial control of excess amounts of lift and roll tendencies.

Still another object is that these small extended airfoil segments have substantial flat bottom surfaces the width of their span, but only a short distance inward from their outer edge and this area creates the individual lift force of each small extended airfoil as they spin. As the substantial flat bottom extends a short distance inwardly to where a small radius starts the formation of the concaved lower surface, which produces less drag do to less area of friction in this area.

A still further object is the addition of a hollow tube device attached by means to the concaved surface. When filled with bubble fluid or the like through a filler hole, it then will automatically release the fluid by gravity and centrifugal forces at the tube's lower end that contains a dispersing screen that contacts the air currents and releases the fluid along the flight path.

Another object is to have the top surface meeting the lower surface at approximately ninety degree angle at their periphery and this feature has the effect of cutting into the wind currents with more ease as it propels itself forward with spin and less turbulance along the underside of the body.

In the preferred embodiment, the aerodynamic toy is balanced and is symmetcally constructed so that a somewhat straight line of flight is achieved when properly launched at the proper trajectory extending away from the thrower, depending on the angle and other forces that the device may encounter. Any departure from its balance and symmetry will produce unpredictable and weird type flight patterns that may also be of interesting amusement.

DESCRIPTION OF THE DRAWING

The invention will be better understood by reference to the following figures in which.

DESCRIPTION OF THE SPECIFIC EMBODIMENT

Figure 2:
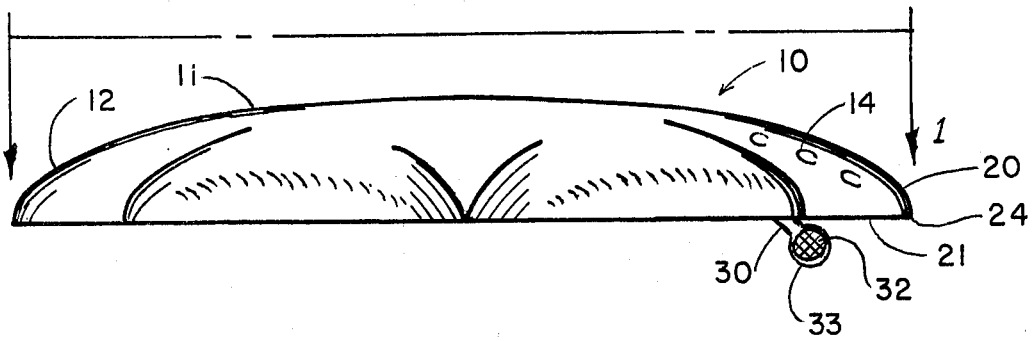
FIG. 2 is a side view of the toy as shown in FIG. 1.
Figure 1:
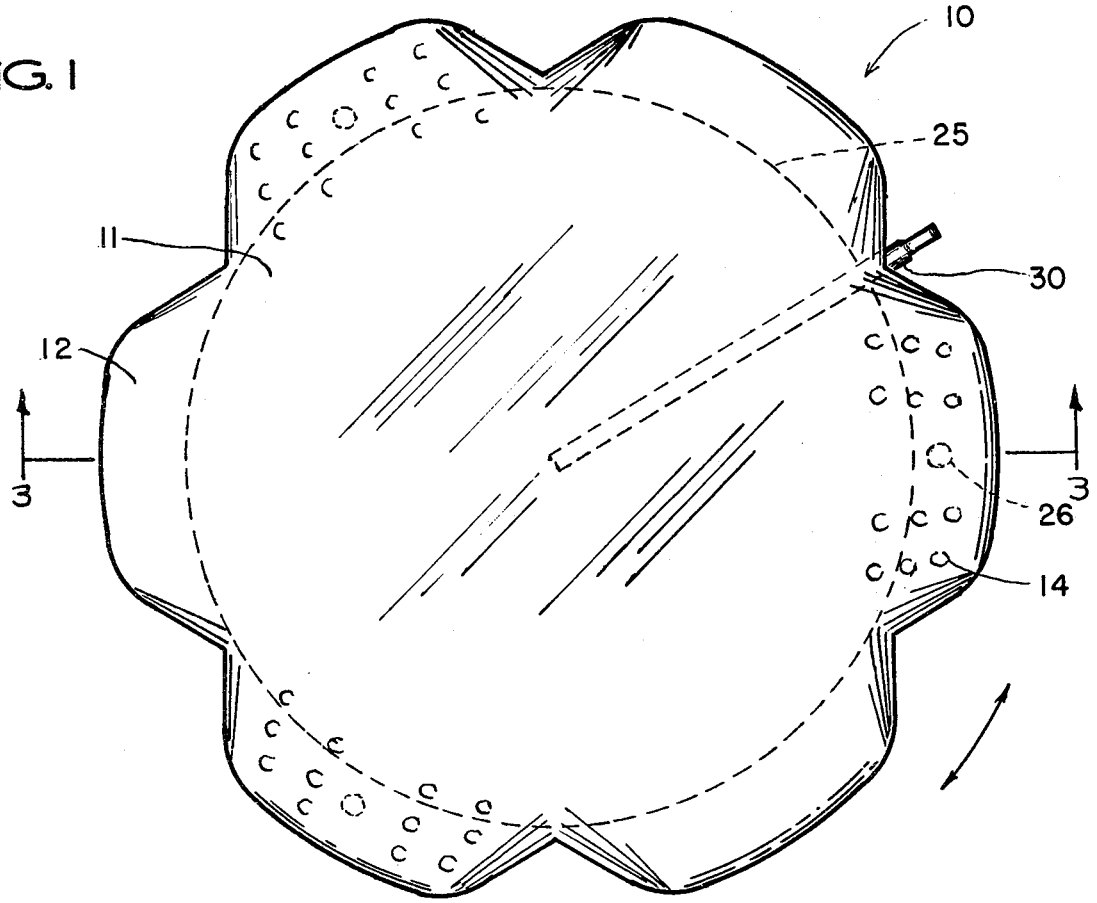
FIG. 1 is a top view of the presently preferred embodiment of the aerodynamic toy of the present invention.
Figure 3:
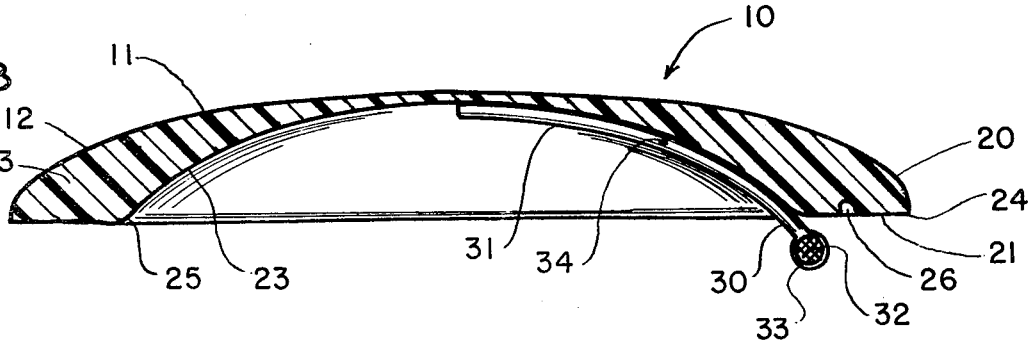
FIG. 3 is a sectional view taken along lines 3—3 of FIG. 1.

Referring to FIG. 1, the top view of an airfoil body 10 according to the present invention, it can be seen that the device embodies small airfoils 12 extending radially from a common center, with portions of the upper surface 11 having slight depressions 14 near the periphery. As shown in FIG. 2 that these small extended airfoils 12 are all in one common plane and compose a large airfoil body 10 as shown in the elevation view in FIGS. 2 and 3. FIGS. 2 and 3 shows these small extended airfoils 12 and the top surface 11 that extends outward from the center and ends with what is approximately a one quarter segment of a circle 20 at the periphery and meets the substantial flat bottom portion 21 forming an approximately ninety degree tip angle 24. This sharp tip angle 24 has some effect upon the flight characteristics of the airfoil body 10 as it facilitates in cutting through the air currents in its forward propelled flights with ease and better flight control.

There is also another flight control feature as seen in FIG. 1 and FIG. 2, which is the shallow depressions 14 which can assume various design forms such as; diamond, elliptical, and square shape or even closely spaced raised ribs. These different types of shallow depressions 14 or raised ribs function as lift spoilers for the destruction of the over abundance of lift produced by this airfoil body 10 and the small airfoils 12, which if not controlled would cause the airfoil body 10 to roll over many times in flight. These lift spoilers 14 cause turbulance and breaks up the smooth flow of air and helps to control the roll-over that is characteristic of this type airfoil body 10. Another control feature for controlling this inherent characteristic of rolling over in flight, is the strong gyroscopic force produced by the spinning of the weighted small airfoils 13, which create a surging type of centrifugal force that acts like a gyro and helps keep the large airfoil body 10 in a level plane while in flight. The gyroscopic force of the spinning weighted small airfoils 13 not only helps to control the roll-over tendency, but also adds greatly to the extra long flights because of the ability of this force to store energy and release it in a spinning and propelling force, for a longer period than would be normal for any other spinning type aerial toy could maintain, unless power driven.

As shown in FIGS. 2 and 3 shows the concaved surface 23 and a substantial flat bottom 21 at the extended tips of each small airfoil 12 which are solid tips 13 and contain most of the weight distribution of the entire airfoil body 10. The substantial flat bottom 21 extends inward just a short distance toward the center of the airfoil body 10, where a small radius 25 begins the outer edge of the concaved lower surface 23 of the airfoil body 10. The parts of the entire lower surface including; the substantial flat bottom 21, tip angle 24, small radius 25 and the concaved surface 23 combine to function in allowing the airstream to flow smoothly across the bottom area of the airfoil body 10 and therefore less drag. Also located in the substantial flat bottom near the periphery are small blind holes 26 for the purpose of adding of extra weight, such as B-Bs, by inserting and gluing them in the small blind holes 26 by the user, if desired.

In FIG. 3 which is a cut away vertical view showing a hollow tube 30 which is attached by means to the concaved surface 23. This hollow tube 30 is sealed at one end to form a reservoir end 31 which lies close to the center of the airfoil body 10, it then extends outward following the arc of the concaved surface 23 until it passes slightly below the substantial flat bottom 21 and terminates with a dispersing screen 32, which is held in place by portion of the hollow tube 30 formed to act as a retaining ring 33 for the dispersing screen 32, which is exposed into the path of the air currents.

To propel this aerial toy into flight it is gripped with the hand by one of the extended small airfoils 12 with the airfoil body 10 in an inverted position (bottom side up). Since this is the normal launching position it then becomes a simple matter for filling the hollow tube's reservoir end 31 with bubble fluid or the like with an eye dropper or similar means through the filler hole 34 in the side of the hollow tube 30 and the fluid will drain into the reservoir end 31. When the airfoil body 10 is thrown into flight the airfoil body 10 will make approximately a half roll, which is normal and then remain in an upright flight attitude for the balance of the flight. With the airfoil body 10 now in this upright position the reservoir end 31 now is at the top of the concaved surface 23 and the bubble fluid begins to flow down the hollow tube 30 and past the filler hole 34 until it contacts the dispersing screen 32. As the bubble fluid contacts the dispersing screen 32 it proceeds to cover the dispersing screen 32 do to gravity and centrifugal forces. At the same time that the bubble fluid floods the dispersing screen 32 the air currents passing through the dispersing screen 32 forcing the bubble fluid out of the dispersing screen 32 in the form of bubbles into the airstream and gives the effect of powered flight or contrails along the airfoil body's 10 flight path. An alternate design of this same hollow tube 30 would be to extend the hollow tube 30 completely across the concaved surface of the airfoil body 10 in order to keep its symmetry and balance with two dispersing screens 32 opposite each other. It is noted that it would be desirable to embed the hollow tube 30 in a recess in the concaved surface 23. But the toy's inherent ability to fly seems to make no great difference in its flying ability even with this extra small weight and drag.

Figure 4:
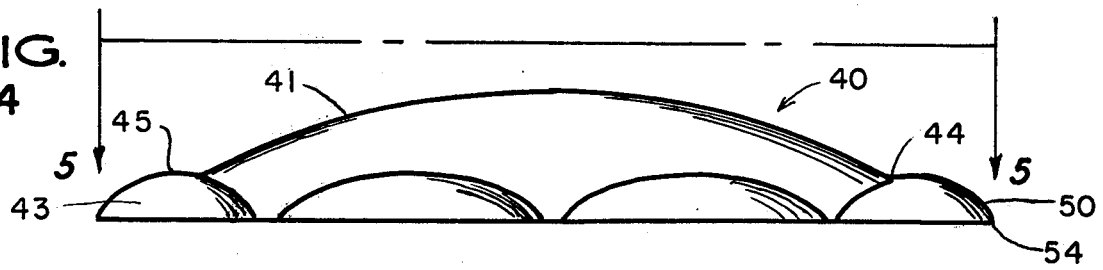
FIG. 4 is a side view of an alternate embodiment.
Figure 5:
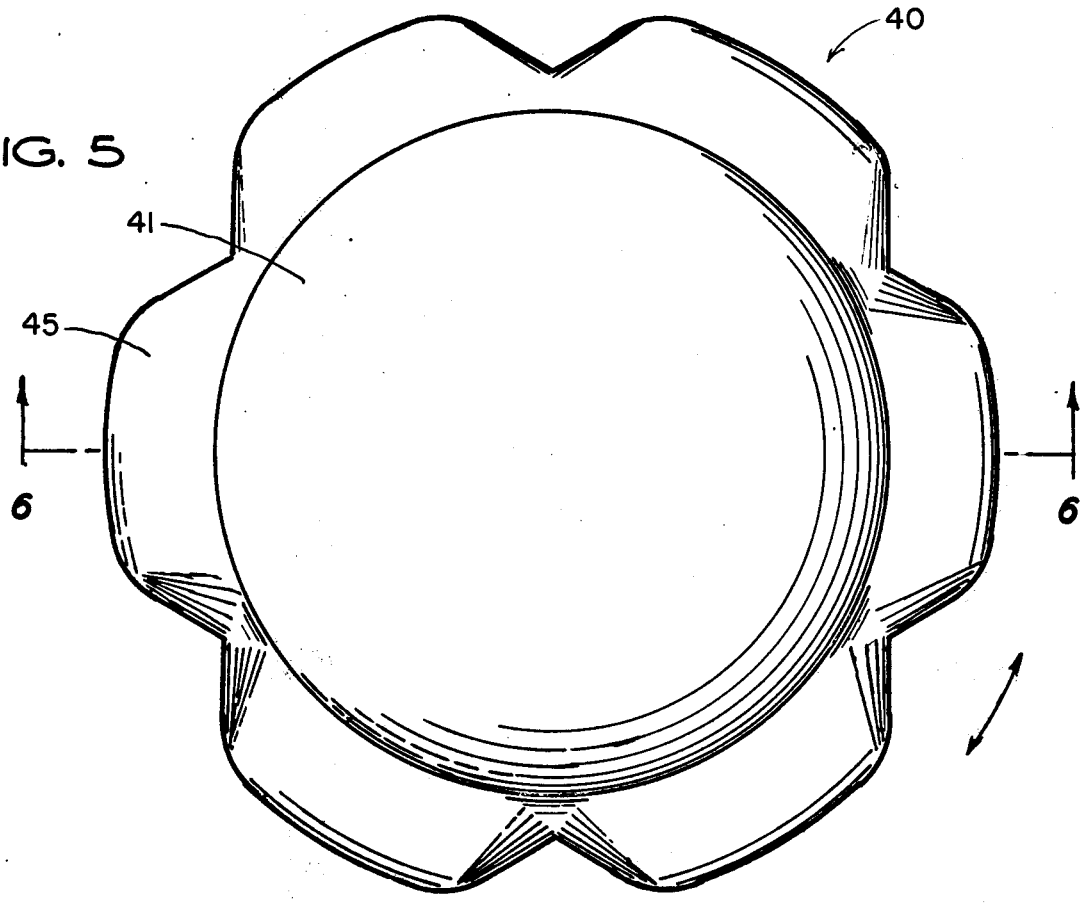
FIG. 5 is a top view taken along lines 5—5 of FIG. 4 of the alternate embodiment of the toy according to the present invention.
Figure 6:
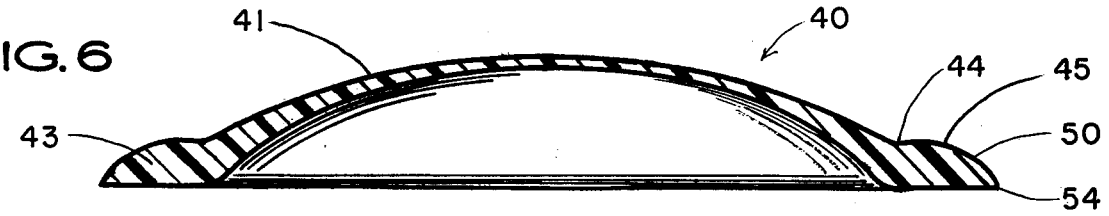
FIG. 6 is a sectional view taken along lines 6—6 of FIG. 5.

FIGS. 4 and 5 illustrate and alternate embodiment of the toy of the present invention. In this embodiment the toy resembles that of FIGS. 1 and 3 with the exception that the upper most surface, known as the first surface 41 terminates and forms one side of a shallow "V" shape 44, then a lower surface, known as the second surface 45 forms the other side of the shallow "V" shape 44, in the elevation view and this second surface 45 then continues downward forming the top surface of the small extended airfoils 43 with a cross section of approximately one quarter segment of a circle 50 and then the ninety degree tip angle 54. In this embodiment as in the previous embodiment, an aerial toy having the same essential parts are included with the same advantages as outlined above with respects to its flying characteristics. The uninterrupted surface and the shallow V-shaped surface of the two embodiments described herein, are illustrative of the several possible configurations which can be molded into the aerial toy.

In the presently preferred embodiment the aerial toy of the present invention can be molded of polyethylene plastic, styrofoam or any suitable material that gives a degree of rigidity necessary for shape retention while at the same time having a degree of softness and flexability. Other versions of the present embodiment are also contemplated such as closely spaced raised ribs or ridges superimposed upon the lift surface areas and to function as lift spoilers. Another version of the present embodiment contemplated is the placing of the weight distribution in out of balance proportions so that flights of weird gyrations could be made for their fascinating appeal.

The invention that I have described and what is claimed is:

1. An aerodynamic toy having an upper surface extending outward from its center, that embodies a series of small extended airfoils, contiguous to one another, forming a larger unitary airfoil body having the general shape of an inverted saucer with scalloped edges formed by the outer most edges of the small extended airfoils, with the tips of these small extended airfoils having a substantial flat bottom near their periphery and the balance of the lower bottom surface being concaved and contains a hollow tube having one end closed and the opposite lower end containing a means for filling and dispersing of fluid, and this dispersing means extends into the air currents that pass through the dispersing means.

2. The toy of claim 1, wherein the underside is a substantial flat bottom at the tips of the small extended airfoils, which are all in the same plane.

3. The toy of claim 1, wherein the weight is unequally distributed with the largest weight of the large unitary body being dispersed to near its periphery.

4. The toy of claim 2, in which the substantially flat bottom of the small extended airfoil tips contain small holes for acceptance of additional weights, that if placed into the holes will be additive to the amount of weight that is already there.

5. The toy of claim 1, in which the upper surface has a plurality of air spoilers.

6. The toy of claim 5, in which the lift spoilers are in the form of shallow depressions.

7. The toy of claim 1, in which the small extended airfoils have their design conformed to a profile configuration, having a thick leading edge facing into the direction of spin for optimum lift forces.

8. The toy of claim 1, wherein the small extended airfoils, in cross section have a surface tha approximates that of a quarter segment of a circle, forming its extreme tip surface and meets the substantially flat bottom surface at approximately a ninety degree angle.

9. The toy of claim 1, in which the upper surface slopes downward to meet the small extended airfoil's top surface and forms a shallow V-shape in cross section, inward of the small extended airfoil tips.

* * * * *